United States Patent [19]

LaPierre et al.

[11] 4,431,519

[45] Feb. 14, 1984

[54] METHOD FOR CATALYTICALLY DEWAXING OILS

[75] Inventors: Rene B. LaPierre, Medford; Randall D. Partridge, Princeton, both of N.J.

[73] Assignee: Mobil Oil Corporation, New York, N.Y.

[21] Appl. No.: 434,205

[22] Filed: Oct. 13, 1982

[51] Int. Cl.[3] ..... C10G 11/00; C10G 11/05; C10G 47/00; C10G 47/16

[52] U.S. Cl. ..... 208/111; 208/120

[58] Field of Search ..... 208/111, 120

[56] References Cited

U.S. PATENT DOCUMENTS

| | | | |
|---|---|---|---|
| 3,136,713 | 6/1964 | Miale et al. | 208/113 |
| 3,254,023 | 5/1966 | Miale et al. | 208/120 |
| 3,267,023 | 8/1966 | Miale et al. | 208/111 |
| 3,530,064 | 9/1970 | Chen et al. | 208/113 |
| 4,260,839 | 4/1981 | Chen et al. | 585/257 |

*Primary Examiner*—Delbert E. Gantz
*Assistant Examiner*—O. Chaudhuri
*Attorney, Agent, or Firm*—Alexander J. McKillop; Michael G. Gilman; Van D. Harrison, Jr.

[57] ABSTRACT

The hydrodewaxing of distillate is enhanced by mixing therewith a product which will react exothermally in supplying heat necessary for the dewaxing operation.

9 Claims, No Drawings

METHOD FOR CATALYTICALLY DEWAXING OILS

BACKGROUND OF THE INVENTION

1. Nature of The Invention

This invention is concerned with reducing the wax content of distillate hydrocarbon fractions by conversion of straight or slightly branched paraffin hydrocarbons contained therein.

2. Prior Art

Distillates obtained from crude oil, such as gas oils have been processed heretofor to produce fuel oil products, including home heating oil, diesel fuel, furnace oil and the like. Specifications for these products normally include a requirement that the pour point may not exceed a certain maximum value. In some instances it is necessary to subject these distillate fuels to additional processing whose principle purpose is to reduce the pour point of the feed stream.

One such process is catalytic hydrodewaxing in which gas oil is contacted with hydrogen and a shape selective catalyst adapted to selectively crack or hydrocrack the paraffinic molecules in the gas oil. Initially the catalysts used were those zeolite cracking catalysts which had pore openings sized so that they would admit and crack only normal paraffins and exclude all the other gas oil components. An example is an erionite-type zeolite. More recently U.S. Pat. No. RE 28,398 has disclosed an improvement in this process where ZSM-5 type zeolites are used in place of the previously used erionite-type cracking catalyst. U.S. Pat. No. RE 28,398 is incorporated herein by reference. This process permits lowering of the gas oil pour point in a very efficient manner. The product of this hydrodewaxing process may be suitably fractionated to produce high yields of dewaxed gas oil boiling in the same range as the feed.

In a hydrodewaxing operation as presently practiced, the vaporized distillate is introduced into a bed of ZSM-5 type crystalline zeolite catalyst at a temperature maintained within the range of 650° F. to 1000° F., a pressure of 100 to 3000 psig and a liquid hourly space velocity of 0.1 to 10 and a hydrogen/hydrocarbon mole ratio between 1 and 20. The hydrodewaxing reaction within the catalytic bed is an endothermic reaction. It is thus necessary ordinarily to superheat the change before admitting it to the catalyst bed. The amount of heat available is controlled by the heat capacity of the super heated reactants and/or inerts used. In an adiabatic commercial unit the temperature drop throughout the reaction bed may be as high as 20° to 50° F. As feeds of an increasing wax content are hydrodewaxed in this process, endotherms or temperature drops as high as 130° F. may be anticipated. As the temperature declines in the reaction bed, the rate of reaction and consequently the rate of dewaxing of the oil diminishes One object of this invention is to provide an improved catalytic dewaxing process wherein the temperature decline in the catalyst bed is minimized. Still another object of this invention is to provide an improved catalytic hydrodewaxing process.

SUMMARY OF THE INVENTION

Briefly stated this invention comprises a process for the catalytic hydrodewaxing of distillates wherein the distillate is fed to a catalyst bed and there is cofed with the distillate a reactant which reacts exothermally, but independently of the distillate, in the presence of the catalyst to provide the heat necessary to maintain the hydrodewaxing reaction within the bed. Preferably the reactant added is a carbon oxygenate such as methanol, ethanol, their respective ethers or mixtures thereof.

DESCRIPTION OF THE INVENTION

The novel process of this invention is concerned with dewaxing of hydrocarbon feedstocks. The term "dewaxing" is used in a specification and claims in its broadest sense and and is intended to mean the removal of those hydrocarbons which will readily solidify (waves) from petroleum stocks. Feedstocks which can be treated include lubricating oil stocks as well as those which have a freeze point or pour point problem, that is, petroleum stocks boiling above about 350° F. The dewaxing can be carried out at either cracking or hydrocracking conditions.

Typical cracking conditions include a liquid hourly space velocity between about 0.5 and about 200, a temperature between about 550° F. and about 1100° F. and a pressure between about subatmospheric and several hundred atmospheres.

When hydrocracking operations are carried out, operating conditions include temperatures between 650° F. and 1000° F., a pressure between 100 and 3000 psig, but preferably between 200 and 700 psig. The liquid hourly space velocity is generally between 0.1 and 10, preferably between 0.5 and 4 and the hydrogen to hydrocarbon mole ratio is generally between 1 and 20 preferably between 4 and 12.

As indicated above, a reactant such as methanol, which will react independently in the presence of the catalyst used in the hydrodewaxing operation is mixed with the incoming feedstock. The catalyst which is used in the catalyst bed, preferably is one from the ZSM-5 zeolite family. The family of ZSM-5 composition has the characteristic X-ray diffraction pattern set forth in U.S. Pat. RE 28,948 and 3,702,886. ZSM-5 compositions can also be identified in terms of mole ratios of oxides, as follows:

$$0.9\pm0.2\ M_{2/n}O:W_2O_3:5\text{-}100\ YO_2:zH_2O$$

wherein M is a cation, n is the valence of said cation, W is selected from the group consisting of aluminum and gallium, Y is selected from the group consisting of silicon and germanium, and z is from 0 to 40. In a preferred synthesized form, the zeolite has a formula, in terms of mole ratios of oxides, as follows $$0.9\pm0.2\ M_{2/n}O:Al_2O_3:\geqq 5\ SiO_2:zH_2O$$

and M is selected from the group consisting of a mixture of alkali metal cations, especially sodium, and tetraalkylammonium cations, the alkyl groups of which preferably contains 2–5 carbon atoms.

In a preferred embodiment of ZSM-5, W is aluminum, Y is silicon and the silica/alumina mole ratio is at least 10 and ranges up to about 1000.

Representative of the ZSM-5 type zeolites are ZSM-5, ZSM-11, ZSM-23, ZSM-35 and ZSM-38. ZSM-5 is disclosed and claimed in U.S. Pat. No. 3,702,886 and U.S. Pat. No. RE 29,948; ZSM-11 is disclosed and claimed in U.S. Pat. No. 3,709,979. Also, see U.S. Pat. No. 3,832,449 for ZSM-12; U.S. Pat. No. 4,076,842 for ZSM-23; U.S. Pat. No. 4,016,245 for ZSM-35 and U.S. Pat. No. 4,406,839 for ZSM-38. The disclosures of these patents are incorporated herein by reference. Of these zeolites ZSM-5 is most preferred. Ordinarily the zeolites will be present as a composite with an inactive porous support material.

As the mixture of feedstock and other reactant passes through the catalyst bed, the independent reactant in this instance methanol, is dehydrated into oxygenated products and water. The dehydration reaction results in the evolution of heat which maintains the temperature at a higher level necessary to effect dewaxing in the reaction bed. We have discovered that in some cases it may be desirable to make the addition of methanol to the oil in an intermittent or pulsing fashion rather than on a continual basis. We have discovered that the presence of methanol in the hydrocarbon stream flowing through the catalyst bed, necessitates a slight increase in temperature to maintain the hydrodewaxing process in the catalyst bed. The presence of the methanol, however, apparently serves to increase the activity of the catalyst. When injection of methanol is suspended, the catalyst is sufficiently active to maintain hydrodewaxing at a stabilized rate as the temperature declines in the reactor bed.

Activity does eventually decline to a point where the injection of methanol must be resumed to introduce more heat into the catalyst bed. The ratio of independent reactant (such as methanol) to the feedstock flowing through the catalyst bed preferably is between about 0.1 and about 10.0 parts by weight of feedstock to one part of oxygenate. The rate of injection of methanol on a pulsed basis can be readily determined by simple experimentation.

EXAMPLE 1

A Nigerian gas oil having an initial pour point of 85° F. was flowed through a fixed catalyst bed of a steamed nickel impregnated acid form of ZSM-5 zeolite in a procedure approximating that described in U.S. Pat. No. RE 28,398. The reaction conditions were 400 psig, 1.0 LHSV and a flow rate of 2500 standard cubic feet of hydrogen per barrel. During this time no additional methanol was added to the stream being processed. Flow was continued over a period of 15 days during which time as the activity of the catalyst declined the reaction temperature was periodically increased to product a gas oil product having a pour point of 0° F. At the end of this 15 day period 5% by volume of methanol was cofed with the gas oil into the reactor bed for a total of 5 days. During this period all of the methanol was converted to hydrocarbons and water. The temperature required to maintain dewaxing activity in the catalyst bed increased significantly while cofeeding the methanol. The reaction temperature necessary to obtain 0° F. pour point gas oil product increased to nearly 790° F. in contrast to the original starting temperature of about 770° F. After the flow of methanol into the reactor bed was discontinued an improvement in catalyst dewaxing activity occurred. The reaction temperature required to obtain the 0° pour point decreased by nearly 50° F. to about 750° F. These results indicate that cofeeding of methanol or other oxygenates can result in an improved dewaxing operation by balancing the heat loss due to the dewaxing reaction. The benefits of pulsed cofeeding of methanol is supported by the data above showing the decline in the temperature necessary to effect dewaxing after the injection of methanol. It should be noted that the increased temperature required to maintain the dewaxing reaction when methanol is cofed is still considerably less than the temperature which would ultimately be required if methanol were not a part of the feed to the catalyst bed.

EXAMPLE 2

A distillate fuel oil having the properties shown in Table 1 was dewaxed using a conventional ZSM-5 zeolite catalyst under reaction conditions of 700° F., 400 psig, 1.0 LHSV and a hydrogen to oil ratio of 2500 standard cubic feet of hydrogen per barrel of oil. Hydrodewaxing was carried out with and without the co-injection of 5% by volume of methanol into the reaction system. The distillate fuel oil products from both reactions were analyzed and their properties are shown in Table 2. A 55% yield of 330° F.+ distillate was obtained when methanol was added to the dewaxing system. In the absence of any added methanol a yield of distillate of only 50% resulted and the pour point was must higher(+45°F.). A completely unexpected beneficial result is illustrated in this example. Note that the volume of distillate recovered is 57 percent of the original charge utilizing the process of our invention (column B) as compared with only 50 percent recovered in the more conventional dewaxing process (column A). This represents a 15 percent increase in recovery.

TABLE 1

| | |
|---|---|
| °D API Gravity | 35.2 |
| ANALYSIS | |
| Hydrogen, % wt. | 13.71 |
| Sulfur, % wt. | 0.082 |
| Nitrogen ppm | 89 |
| basic ppm | 25 |
| CCR, % wt. | 0.07 |
| Paraffins, % wt. | 71.4 |
| Napthenes, % wt. | 4.8 |
| Aromatics, % wt. | 23.9 |
| Pour Point, °F. | 110 |
| KV CS @ 100° C. | 2.48 |
| Distillation (D-1160) | |
| IBP % vol | 491° F. |
| 5 | 612 |
| 10 | 642 |
| 50 | 712 |
| 90 | 749 |
| 95 | 755 |

TABLE 2

| Process | Charge | A | B |
|---|---|---|---|
| Reactor Conditions | | | |
| Vol. % of cofeed | — | — | 5% $CH_3OH$ |
| Temperature, °F. | — | 670 | 700 |
| Pressure psig | — | 400 | 400 |
| LHSV | — | 1.0 | 1.0 |
| $H_2$ at Inlet SCF/BBL | — | 2500 | 2500 |
| Product Distribution, % wt.: | | | |
| C1-C3 | — | 3.8 | 6.3 |
| C4's | — | 8.7 | 11.4 |
| C5 - 330° F. naphtha | — | 38.8 | 27.2 |
| 330° F. + Distillate | 100.0 | 50.0 | 57.2 |
| Pour Point, °F. | 110 | 45 | −40 |

What is claimed is:

1. A process for dewaxing a petroleum fraction utilizing a ZSM-5 type zeolite catalyst and an organic compound which will react exothermally in the presence of said zeolite under the same dewaxing conditions comprising:

(a) mixing said petroleum fraction and said organic compound;

(b) contacting the resultant mixture with said ZSM-5 type catalyst in a reaction zone under dewaxing conditions; and (c) separating from the resulting reaction mixture a dewaxed petroleum fraction.

2. The process of claim 1 wherein said petroleum fraction is a gas oil having a boiling point above about 350° F.

3. The process of clam 1 wherein said petroleum fraction is lubricating oil stock.

4. The process of claim 1 wherein said organic compound is selected from the group consisting of methanol, ethanol, their respective ethers or mixtures thereof.

5. The process of claim 1 wherein said organic compound is methanol.

6. The process of claim 1 wherein said zeolite is selected from the group consisting of ZSM-5, ZSM-11, ZSM-12, ZSM-23, ZSM-35 and ZSM-38.

7. The process of claim 1 wherein said zeolite is ZSM-5 zeolite.

8. The process of claim 1 wherein said organic compound is added intermittently to said petroleum fraction.

9. The process of claim 1 wherein said organic compound is added at two or more locations in said reaction zone.

* * * * *